US008210796B2

(12) United States Patent
Hernandez et al.

(10) Patent No.: US 8,210,796 B2
(45) Date of Patent: Jul. 3, 2012

(54) LOW EXHAUST LOSS TURBINE AND METHOD OF MINIMIZING EXHAUST LOSSES

(75) Inventors: Nestor Hernandez, Schenectady, NY (US); Kamlesh Mundra, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 1114 days.

(21) Appl. No.: 12/103,228

(22) Filed: Apr. 15, 2008

(65) Prior Publication Data

US 2009/0257878 A1 Oct. 15, 2009

(51) Int. Cl.
*F01D 3/02* (2006.01)

(52) U.S. Cl. ..... 415/94; 415/99; 415/103

(58) Field of Classification Search ..... 415/94, 415/99–103, 95

See application file for complete search history.

(56) References Cited

U.S. PATENT DOCUMENTS 4,557,113 A * 12/1985 Silvestri et al. ..... 60/693
5,075,074 A * 12/1991 Gluntz ..... 376/371

FOREIGN PATENT DOCUMENTS

| | | |
|---|---|---|
| JP | 59150909 | 8/1984 |
| JP | 60237103 | 11/1985 |
| JP | 63195303 | 8/1988 |
| JP | 63195304 | 8/1988 |
| JP | 09041906 | 2/1997 |
| JP | 10121910 | 5/1998 |

* cited by examiner

*Primary Examiner* — Edward Look
*Assistant Examiner* — Liam McDowell
(74) *Attorney, Agent, or Firm* — Cantor Colburn LLP

(57) ABSTRACT

Disclosed herein is a method of minimizing losses in a multiple-last-stage bucket turbine. The method includes, determining an inlet flow available for the multiple-last-stage bucket turbine, and selecting multiple last-stage buckets from a set of pre-designed last-stage buckets. The multiple last-stage buckets having inlet flows different from one another that when combined match the inlet flow available with a lower total exhaust loss than from multiple same sized last-stage buckets from the set of pre-designed last-stage buckets.

10 Claims, 2 Drawing Sheets

LOW EXHAUST LOSS TURBINE AND METHOD OF MINIMIZING EXHAUST LOSSES

BACKGROUND OF THE INVENTION

Minimizing losses and modifying performance in machinery, such as a steam turbine engine, for example, is of interest to operators of such machines. Last-stage bucket (LSB) performance plays a significant role in the overall performance of a steam turbine. Designing and developing a completely new last-stage bucket can be costly and take years to complete due to all the expensive and extensive tests needed before proving production ready. As such, it is not uncommon to select a last-stage bucket from a selection of pre-designed last-stage buckets for use in new applications or for replacement in existing applications. In such cases, a designer typically selects the pre-designed last-stage bucket that is the most economical. In low-pressure turbine applications, using multiple last-stage buckets includes using two or more of the same selected pre-designed last-stage buckets. Doing so, however, can result in less than desirable performance of the last-stage buckets and thus the low-pressure turbine.

BRIEF DESCRIPTION OF THE INVENTION

Disclosed herein is a method of minimizing losses in a multiple-last-stage bucket turbine. The method includes, determining an inlet flow available for the multiple-last-stage bucket turbine, and selecting multiple last-stage buckets from a set of pre-designed last-stage buckets. The multiple last-stage buckets having flows different from one another that when combined match the inlet flow available with a lower total exhaust loss.

Further disclosed herein is a method of modifying performance of a multiple-last-stage bucket turbine. The method includes, determining an inlet flow available for the multiple-last-stage bucket turbine, and proportioning different amounts of flow available to each of multiple pre-designed differently sized last-stage buckets thereby minimizing exhaust losses of the multiple-last-stage bucket turbine as compared to proportioning equal portions of the total flow available to each of multiple pre-designed same sized last-stage buckets Further disclosed herein is a multiple-last-stage bucket turbine. The multiple-last-stage bucket turbine includes, a first last-stage bucket selected from a group of pre-designed last-stage buckets, and at least one additional last-stage bucket(s), different from the first last-stage bucket, selected from the group of pre-designed last-stage buckets, the first last-stage bucket and the at least one additional last-stage bucket (s) having a combined exhaust loss that is less than a combined exhaust loss from any multiple same sized last-stage buckets selected from the group of pre-designed last-stage buckets.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
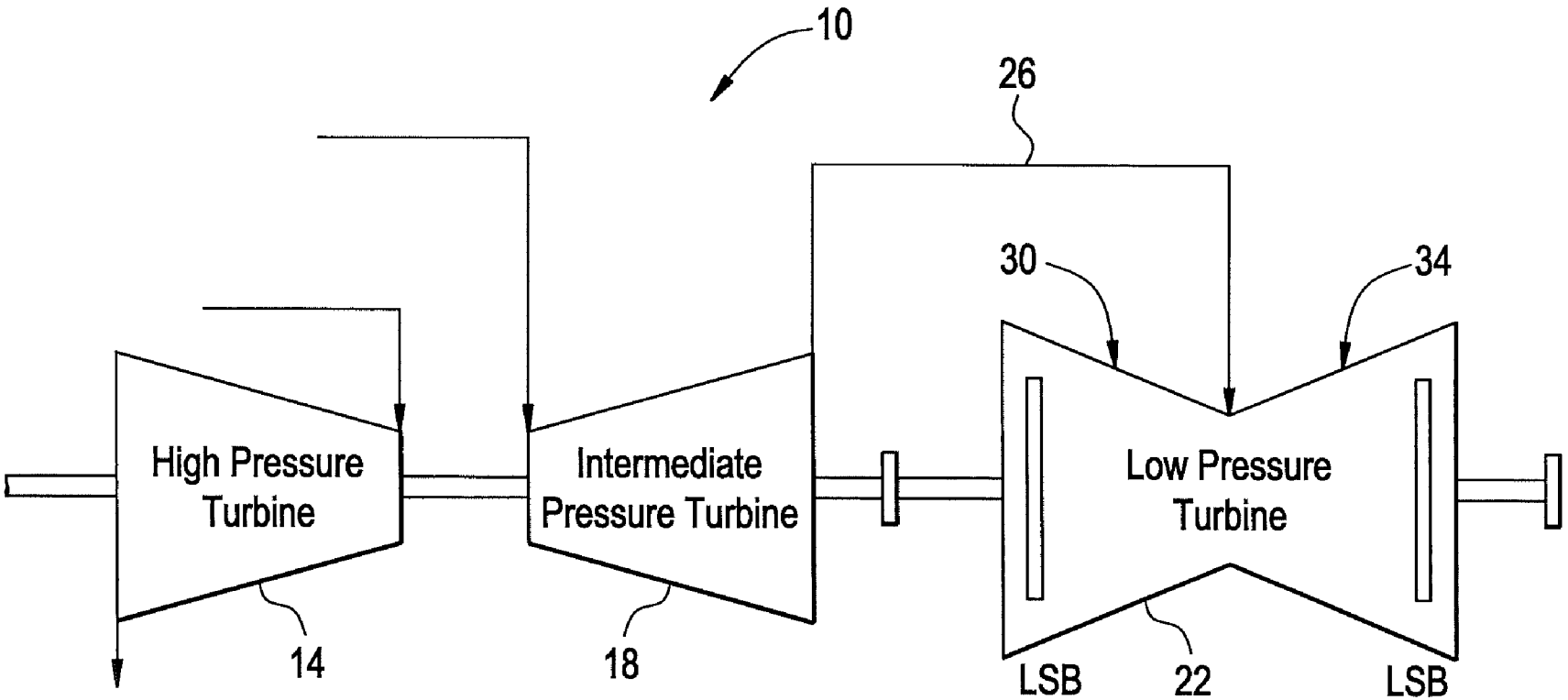
FIG. 1 depicts a partial schematic of a steam turbine engine.

Referring to FIG. 1, a schematic of a steam turbine engine 10 is illustrated. The steam turbine engine 10 includes, a high-pressure turbine 14, an intermediate-pressure turbine 18 and a double flow low-pressure turbine 22 disclosed herein. The double flow low-pressure turbine 22 has an available inlet flow 26 defined by steam supplied from exhaust of the intermediate-pressure turbine 18. The double flow low-pressure turbine 22 includes two last-stage buckets 30, 34. Methods, disclosed herein, of choosing the two last-stage buckets 30, 34 in order to achieve a desirable performance of the double flow low-pressure turbine 22, will be described in detail below. Although a double flow low-pressure turbine is disclosed in the above embodiment, alternate embodiments could employ multiple low-pressure turbines with multiple low-pressure flows.

Figure 2:
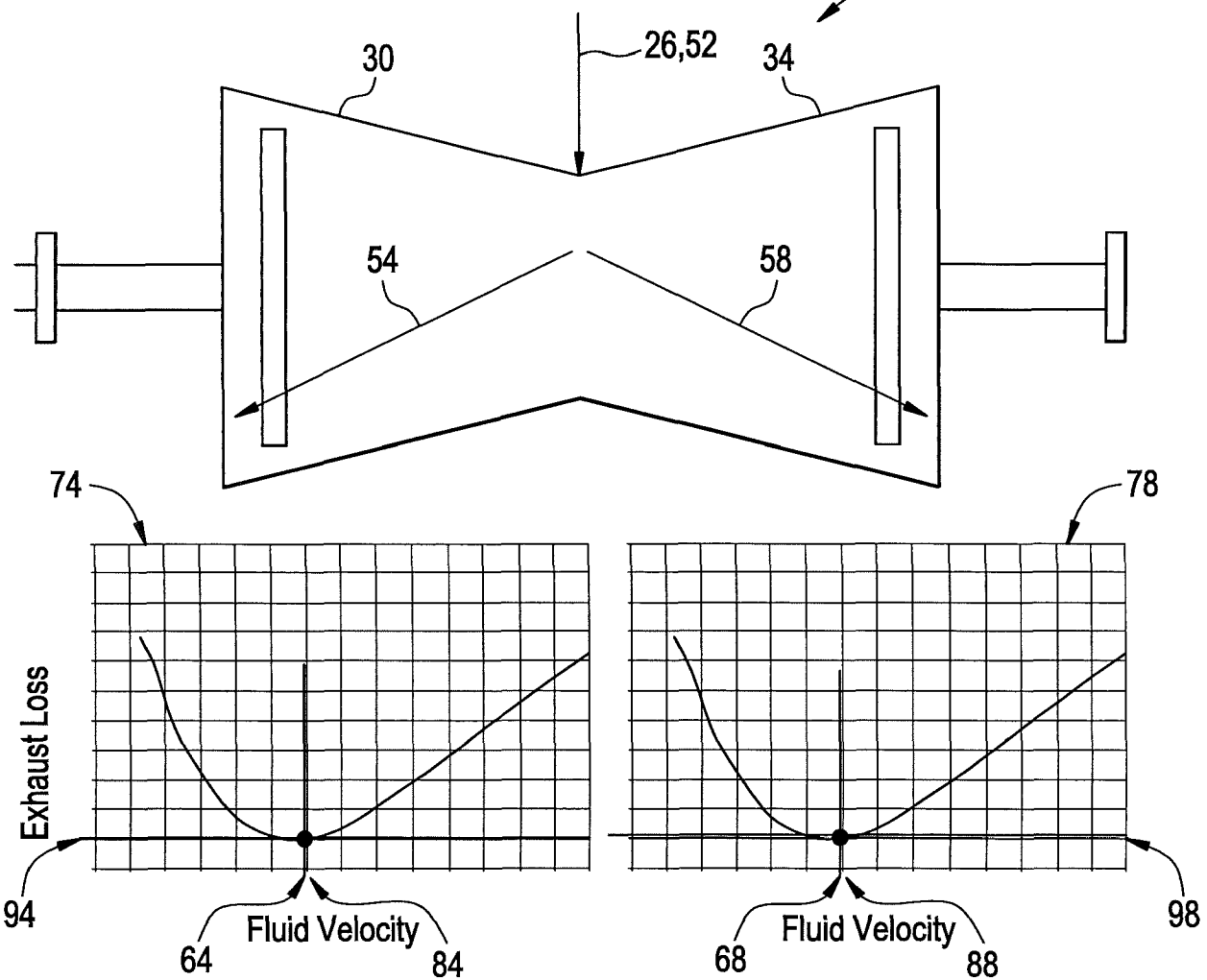
FIG. 2 depicts a low-pressure multiple-last-stage bucket turbine section having multiple last-stage buckets with differing flow areas and curves of exhaust loss versus fluid velocity for each of the last-stage buckets.

Referring to FIG. 2, the double flow low-pressure turbine 22, in an embodiment of the invention disclosed herein, is illustrated that includes the first last-stage bucket 30 and the second last-stage bucket 34. The first last-stage bucket 30 and the second last-stage bucket 34, are of different sizes and thus each of the last-stage buckets 30, 34 have a different flow area. The available inlet flow 26, to the double flow low-pressure 22, is divided unevenly such that a first inlet flow 54 flowing to the first last-stage bucket 30 is greater than a second inlet flow 58 flowing to the second last-stage bucket 34. As such, the first inlet flow 54 is greater than half the available inlet flow 26 and the second inlet flow 58 is less than half the available inlet flow 26. In alternate embodiments, these flow relationships could be reversed such that the first inlet flow 54 flowing to the first last-stage bucket 30 is less than the second inlet flow 58 flowing to the second last-stage bucket 34. The inlet flows 54, 58 and flow areas determine fluid velocities 64, 68 through the last-stage buckets 30, 34 respectively, based upon the equation:

$$\text{Velocity}=(\text{Volumetric Flow})/(\text{Area}) \quad (1)$$

Each of the last-stage buckets 30, 34, has a relationship between performance (as measured by exhaust loss) and fluid velocity as depicted in curves 74 and 78, respectively. The curves 74, 78 reveal desired fluid velocities 84, 88 based upon a minimizing of exhaust losses 94, 98. Since, as can be seen in the curves 74, 78, the fluid velocities 64, 68 for the last-stage buckets 30, 34 operating at the flows 54, 58, are substantially equal to the desired fluid velocities 84, 88, the last-stage buckets 30, 34 are operating at their desired performance levels. In this embodiment, the exhaust losses 94 and 98 are at a minimum of the curves 74 and 78, respectively. Since the first inlet flow 54 causes the desired fluid velocity 84, the first inlet flow 54 is also the desired inlet flow for the first last-stage bucket 30. Similarly, since the second inlet flow 58 causes the desired fluid velocity 88, the second inlet flow 58 is also the desired inlet flow for the second last-stage bucket 34.

By using the two last-stage buckets 30, 34 with the different desired inlet flows 54, 58, the combined desired inlet flow 52 can be made to match the available inlet flow 26. Embodiments disclosed herein can allow a designer to more accurately match a combined desired inlet flow to a multiple-last-stage bucket turbine with an available inlet flow than can be achieved by current methods of using two same sized last-stage buckets from the available pre-designed last-stage buckets. This mismatch causes the buckets to operate at inlet flows that are above or below their desired inlet flow, which correlates with a fluid velocity for each of the last-stage buckets that is either greater than or less than their desired fluid velocities. This can be visualized on the curves 74 and 78, as operating at exhaust losses that are above the desired exhaust losses 94 and 98. Since operation of each of the last-stage buckets 30 and 34 must be along the lines on the curves 74 and 78, respectively, any time the operation of a last-stage bucket is above the desired exhaust losses 94 and 98, the last-stage bucket is operating at one of two points on the line; one being above the desired fluid velocities 84 and 88 and the other being below the desired fluid velocities 84 and 88. In such a condition the combined exhaust losses would be greater than the combined exhaust losses of two last-stage buckets operating at the desired exhaust losses 94, 98.

Since only a finite number of pre-designed last-stage buckets exist (and, as such, are available for selection), and the time, expense and effort to develop new last-stage buckets for some new applications (and many service replacement applications) can be prohibitive, embodiments disclosed herein provide tools that a designer can use to select last-stage buckets from a finite list of pre-designed last-stage buckets. Designers of turbine systems can select the multiple differently sized last-stage buckets 30 and 34 (from a list of pre-designed and available last-stage buckets) that together will have a combined desirable inlet flow 52 that matches the total inlet flow 26 available with a lower total exhaust loss, than could be matched by using multiple, pre-designed, same sized last-stage buckets. Once the multiple last-stage buckets are chosen, the designer simply designs the flow split based on low pressure turbine inlet area ratios or any other mechanical device, to divide the desired inlet flow 52 to improve the desired inlet flows 54, 58 to each of the two last-stage buckets 30, 34, respectively. The same can be done for multiple low pressure flows to, for example, 3, 4, 5 or 6 last-stage buckets, depending on the size of the steam turbine.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of modifying performance of a multiple-last-stage bucket turbine, comprising:

determining a total inlet flow available for the multiple-last-stage bucket turbine; and proportioning different amounts of the total inlet flow available to each of multiple pre-designed differently sized last-stage buckets thereby minimizing exhaust losses of the multiple-last-stage bucket turbine as compared to proportioning portions of the total inlet flow available to each of multiple pre-designed same sized last-stage buckets.

2. The method of claim 1, further comprising modifying performance of a low-pressure multiple-last-stage bucket turbine.

3. The method of claim 1, wherein the proportioning includes splitting the total inlet flow available to match a desired inlet flow for each of the multiple pre-designed differently sized last-stage buckets based on an exhaust loss versus fluid velocity curve for each of the multiple pre-designed differently sized last-stage buckets.

4. The method of claim 3, further comprising calculating the fluid velocity using an area and a flow.

5. The method of claim 3, further comprising calculating the fluid velocity as an area times a volumetric flow.

6. A multiple-last-stage bucket turbine, comprising:

a first last-stage bucket selected from a group of pre-designed last-stage buckets; and at least one additional last-stage bucket(s), being differently sized from the first last-stage bucket, selected from the group of pre-designed last-stage buckets, the first last-stage bucket and the at least one additional last-stage bucket(s) having a combined exhaust loss that is less than a combined exhaust loss from any multiple same sized last-stage buckets selected from the group of pre-designed last-stage buckets.

7. The multiple-last-stage bucket turbine of claim 6, further comprising an inlet flow splitting mechanism that divides the total inlet flow available to the first last-stage bucket and the at least one additional last-stage bucket(s) unevenly.

8. The multiple-last-stage bucket turbine of claim 7, wherein the inlet flow splitting mechanism includes a different low-pressure turbine area ratio between multiple low-pressure flows or any other mechanical devise.

9. The multiple-last-stage bucket turbine of claim 6, wherein the group of pre-designed last-stage buckets includes existing last-stage buckets.

10. The multiple-last-stage bucket turbine of claim 6, wherein the multiple-last-stage bucket turbine is a low-pressure multiple-last-stage bucket turbine.

* * * * *